US009790023B2

(12) United States Patent
Omuta et al.

(10) Patent No.: US 9,790,023 B2
(45) Date of Patent: Oct. 17, 2017

(54) CONTAINER-CONNECTING FITTING

(75) Inventors: Mamoru Omuta, Hyogo (JP); Yukio Hanashiro, Hyogo (JP)

(73) Assignee: ROKKO ENGINEERING CO. LTD., Hyogo (JP)

( * ) Notice: Subject to any disclaimer, the term of this patent is extended or adjusted under 35 U.S.C. 154(b) by 1415 days.

(21) Appl. No.: 13/638,843

(22) PCT Filed: Apr. 1, 2011

(86) PCT No.: PCT/JP2011/058460

§ 371 (c)(1),
(2), (4) Date: Oct. 23, 2012

(87) PCT Pub. No.: WO2011/125953

PCT Pub. Date: Oct. 13, 2011

(65) Prior Publication Data

US 2016/0368706 A1 Dec. 22, 2016

(30) Foreign Application Priority Data

Apr. 3, 2010 (JP) ..... 2010-086613

(51) Int. Cl.
*B65D 90/00* (2006.01)
*B65D 88/12* (2006.01)

(52) U.S. Cl.
CPC ..... *B65D 90/0006* (2013.01); *B65D 88/12* (2013.01)

(58) Field of Classification Search
CPC ..... B65D 90/0013; B60P 7/13; B60P 7/132; B66C 1/663
See application file for complete search history.

(56) References Cited

U.S. PATENT DOCUMENTS 3,368,838 A * 2/1968 Reich ..... B60P 7/132 24/287
3,398,922 A * 8/1968 Martin ..... B60P 7/13 410/85
3,647,172 A 3/1972 Van Der Molen
3,683,463 A * 8/1972 Siefer ..... B60P 7/13 24/287

(Continued)

FOREIGN PATENT DOCUMENTS

GB 1205499 A * 9/1970 ..... B65D 90/0033
GB 1524846 A * 9/1978 ..... B65D 90/0013

(Continued)

*Primary Examiner* — Daniel Wiley
(74) *Attorney, Agent, or Firm* — R. Neil Sudol; Henry D. Coleman

(57) ABSTRACT

To provide a preferable container-connecting fitting with which it is possible to anchor a container using a cable, a connecting fitting is, at a part thereof, fitted into non-circular hole in the container and is connected to the cable. The fitting has a shaft part to be inserted into the hole in the container. One end side of the shaft part is provided with a first flange which can pass through the hole only when positioned at a specific angle about the center line of the shaft part, and the other side of the shaft part is provided with a second flange that is too large to pass through the hole. Further, a cable connecting part is mounted on an opposite side where the first flange is present, the second flange being interposed therebetween, so as to be able to rotate, about the center line of the shaft part.

10 Claims, 4 Drawing Sheets

(56) References Cited

U.S. PATENT DOCUMENTS

| | | | | | |
|---|---|---|---|---|---|
| 3,709,455 | A | | 1/1973 | Last | |
| 3,749,438 | A | * | 7/1973 | Loomis | B66C 1/663 294/81.53 |
| 3,792,892 | A | * | 2/1974 | Shields | B66C 1/663 294/81.53 |
| 4,139,228 | A | * | 2/1979 | Varadi | B66C 1/663 294/81.53 |
| 4,212,251 | A | * | 7/1980 | DiMartino | B65D 90/0013 220/1.5 |
| 4,497,602 | A | * | 2/1985 | McCarthy | B60P 7/13 244/118.1 |
| 4,541,662 | A | * | 9/1985 | Berg | B66C 1/663 294/82.1 |
| 4,925,226 | A | * | 5/1990 | Leonard, Jr. | B66C 1/663 294/102.1 |
| 8,876,426 | B2 | * | 11/2014 | Lanigan, Sr. | B60P 7/132 403/353 |
| 2003/0215299 | A1 | | 11/2003 | Hsieh | |

FOREIGN PATENT DOCUMENTS

| | | | | | |
|---|---|---|---|---|---|
| GB | 2527038 | A | * | 12/2015 | B65D 90/0013 |
| JP | 48-040425 | Y1 | | 11/1973 | |
| JP | 096694/1973 | | | 11/1973 | |
| WO | WO0043303 | A1 | | 7/2000 | |

* cited by examiner

CONTAINER-CONNECTING FITTING

TECHNICAL FIELD

The claimed invention relates to a container-connecting fitting to be used in order to anchor containers in a stacked state with a rope or the like.

BACKGROUND ART

It is common for containers to be stacked in a plurality of stages both when being transported by ship or the like and when being stored at port or the like. However, simple stacking in some cases does not give adequate stability for strong winds and waves, shaking, and the like, and therefore containers are often anchored to each other or a container is anchored to a part of the floor or the ground, with a rod, a rope, or the like.

Patent Literature 1 discloses a container binding rod used for such a purpose. The disclosed rod has a fitting called a fork at the upper end part, and first and second stoppers are formed on this fork. A locking hole is provided at the corner (corner portion) of the container, and so after insertion of the fork into the locking hole of the container at the upper stage, the rod is rotated by a specific angle, and then the action of the first and second stoppers causes the fork to engage with the locking hole. The upper end part of the rod is thus connected to the container at the upper stage, and the lower end part of the rod is connected to a mounting base on the ground via a rotation clamp (a turnbuckle) or the like. As the container at the upper stage is connected to the mounting base with the binding rod or the like, the stability of the stacked containers is improved, as a result of which it is possible to prevent collapsing or the like of the containers.

CITATION LIST

Patent Literature

[PLT 1] Japanese Unexamined Utility Model Application Publication No. S60-184892

SUMMARY OF INVENTION

Technical Problem

The container binding rod disclosed in Patent Literature 1 has the following problems.

a) Because the rod and fork are integrally connected, when the rod is rotated, the fork, too, rotates by the same angle as well. Using such a structure means that the rod is rotated by a specific angle to thereby engage the fork with the locking hole in the aforementioned manner. However, because the fork rotates together with the rod, it is probable for the fork to fall out of the state of engagement (binding) with the locking hole when the rod is not used at a determined angle (the aforementioned specific angle).

b) Since the fork is integrally connected to the rod and both the fork and rod are manufactured of steel or the like, these are heavy and not easily handled.

The claimed invention, which is contrived to resolve the foregoing problems, provides a preferable container-connecting fitting with which it is possible to anchor a container using not a rod but rather a variety of cables (for example, a rope, a belt, and a wire) and to prevent the cable from being disengaged from the container even if the cable is used at any angle.

Solution to Problem

A connecting fitting according to the present invention is a container-connecting fitting, which is, at a part thereof, fitted into a non-circular hole of a container and is connected to a cable, in order to anchor the container with the cable, wherein the container-connecting fitting has a shaft part to be inserted into the hole, one end side of the shaft part being provided with a first flange which can pass through the hole only when positioned at a specific angle about a center line of the shaft part, and the other side of the shaft part (a side apart from the side to which the first flange is provided) being provided with a second flange that is too large to pass through the hole, and a cable connecting part is mounted on a side opposite the side where the first flange is present, the second flange being interposed therebetween, so as to be able to rotate, without limitation to the angle, about the center line of the shaft part.

A connecting fitting 10 illustrated in FIG. 3 is one example thereof; a first flange 12 and a second flange 13 are provided to both sides of a shaft part 11, and a freely rotating cable connecting part 15 is mounted on a side opposite the side where the first flange 12 is present, the second flange 13 being interposed therebetween.

The "non-circular hole" of the container indicates the locking hole in the example of the aforementioned Patent Literature; in an ordinary container, an oval hole is formed at a corner fitting, called a casting, mounted on four corners (at eight points). The "flange" referenced herein refers to a brim-shaped portion formed on the outer peripheral edge of the shaft part. The "first flange" may have a shape similar to the hole or smaller in area (such as an elongated shape, for example), provided that positioning the same at a specific angle allows it to pass through the non-circular hole of the container.

The aforementioned connecting fitting can be easily mounted on a container with the following procedure. Namely, the first flange is positioned at the specific angle mentioned above and thereby passed through the non-circular hole of the container, and the shaft part is inserted into the non-circular hole almost before the second flange, then the shaft part and the first and second flanges are rotated by a suitable angle. In a case where the hole of the container is an oval, it is suitable to rotate the shaft part and the flanges by about 90°. When between the first and second flanges there is an interval greater than or equal to the thickness of the member having the hole, the first and second flanges sandwich this member after being rotated in this manner, thus preventing the first flange from falling out of the hole.

When mounted in this manner, the cable connecting part of the connecting fitting is outside of the hole of the container together with the second flange, for example, as shown in FIG. 2. The cable is connected to the cable connecting part outside of the container, and then connected to (a connecting fitting mounted on) another container or a similar fixing apparatus on the ground or the like, whereby the stability of the container can be improved to prevent collapsing thereof. When connecting the cable to a container at the upper stage via the connecting fitting of the present invention, it is preferable that the connecting fitting is mounted on the hole and the cable is connected to the cable connecting part of the fitting before the container is lifted up (or picked up).

Because the cable connecting part is able to rotate about the shaft part without limitation to the angle, the cable can be smoothly connected thereto. Moreover, since such rotation is allowed, an inappropriate force does not act on the connecting fitting even though the tension of the connected cable acts at any angle about the center line of the shaft part, and there is no rotation to an angular position at which the shaft part or first flange falls out of the non-circular hole. Since an inappropriate force does not act and the first flange does not fall out of the hole, the cable can be used at any angle. Moreover, because the connecting fitting and the cable are not integrated, it is possible to previously operate the connecting fitting alone by hand to mount it on the container, whereby a further advantage emerges in that handling is easy, unlike with the rod in Patent Literature 1.

The connecting fitting of the present invention preferably has a structure such that the center of gravity of the same, in a state where the cable is not connected, is on a side opposite the side where the first flange is present, with the second flange interposed therebetween.

When the connecting fitting of which the center of gravity is thus set is mounted on the hole of the container, the center of gravity thereof is placed outside of the hole. For this reason, the connecting fitting inclines slightly in an orientation that the cable connecting part is lowered, and comes into contact with each of the parts inside the hole with a locally large contact surface pressure of which the up-down orientation and the like are not the same; as a result, the shaft part and the like are less prone to rotate relative to the hole. Since the shaft part and the like are less prone to rotate, rotation to an angular position where the first flange unintentionally falls out of the non-circular hole before the tension of the cable acts can be avoided during the operation of mounting the connecting fitting on the container.

The second flange may further have a projecting part formed to project in a direction oriented outward from the center line of the shaft part or in an orientation opposite the side where the first flange is present. For example, FIG. 3 (see especially FIGS. 3(*b*) and 3(*c*)) illustrates an example where a projecting part 13*a* as mentioned above, is formed on the second flange 13.

Provided as mentioned above on the second flange, the projecting part can be operated by hand or hit with a hammer or the like to easily rotate the shaft part and the like when mounting the connecting fitting on or dismantling the same from the container. This ease of rotation is of particularly major significance in a case where, as mentioned above, the setting of the position of the center of gravity hinders smooth rotation of the shaft part and the like.

It is also preferable that the connecting fitting has a structure such that the cable connecting part has an inclined portion oriented to be increasingly apart from the second flange as going outward from the center line of the shaft part, and has a connection hole at the tip of the aforementioned inclined portion. In the example in FIG. 3(*a*), a connecting part 14 is provided with an inclined portion as mentioned above, toward a connection hole 14*a*.

The connection hole is provided together with the inclined portion, so that, for example, as shown in FIG. 2(*a*), the connection hole is located somewhat apart outwardly from the wall surface of the container. This prevents a connecting component from contacting with a wall surface of the container and facilitates the task of connecting with the cable.

It is particularly preferable that the cable is a belt having a hook, including a latching apparatus at an end part, and also having a length-adjusting means. A belt 3 in FIG. 4 is an example of such a cable, and has a hook 4 including a spring-type latch 5 at an end part, together with an accompanying ratchet 6 acting as the length-adjusting means.

A belt (made of synthetic fiber or the like) is used as the cable, so that the weight thereof is lighter and handling is easier in comparison to the case where a metal rod or chain, wire rope, or the like is used. When the length-adjusting means to adjust the length is provided as mentioned above, it is also very easy to make a connection between any points. When the hook provided with the latching apparatus is provided to the end part of the belt, there is no longer a concern that the belt falls out of the connecting fitting before tension is applied.

Advantageous Effects of Invention

The connecting fitting according to the present invention is easily handled and can be very easily mounted on a container. Because the cable connecting part is freely able to rotate about the shaft part, it can be easily connected with the cable, and there is no shortcoming therein irrespective of the angle at which the cable is used.

When the position of the center of gravity has been appropriately set, it is possible to avoid a case where the shaft part or the like is unintentionally rotated and the first flange falls out of the non-circular hole.

When the projecting part projecting outward or the like is formed on the second flange, the shaft part and the like can be easily rotated during mounting the connecting fitting on or dismantling the same from the container.

When the inclined portion extended to the connection hole is provided on the cable connecting part, a connecting component is difficult to contact with the wall surface of the container and the task of connecting with the cable is easier.

When a belt having a hook with a latching apparatus at an end part and also having a length-adjusting means is used as the cable, the advantages is that not only the weight thereof is lighter, so that handling is easier, but also a connection can be made between any points, so that the belt does not fall out of the connecting fitting.

DESCRIPTION OF EMBODIMENTS

FIGS. 1-4 illustrate embodiments of the invention.

Figure 1B:
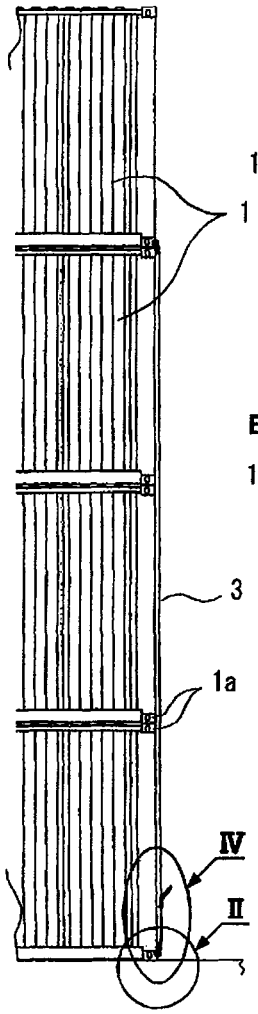
FIG. 1(*a*) is a front view and FIG. 1(*b*) is a partial side view, for illustrating a state where a connecting fitting 10 or a belt (cable) 3 according to the present invention is used to connect containers 1 to each other.
Figure 1A:
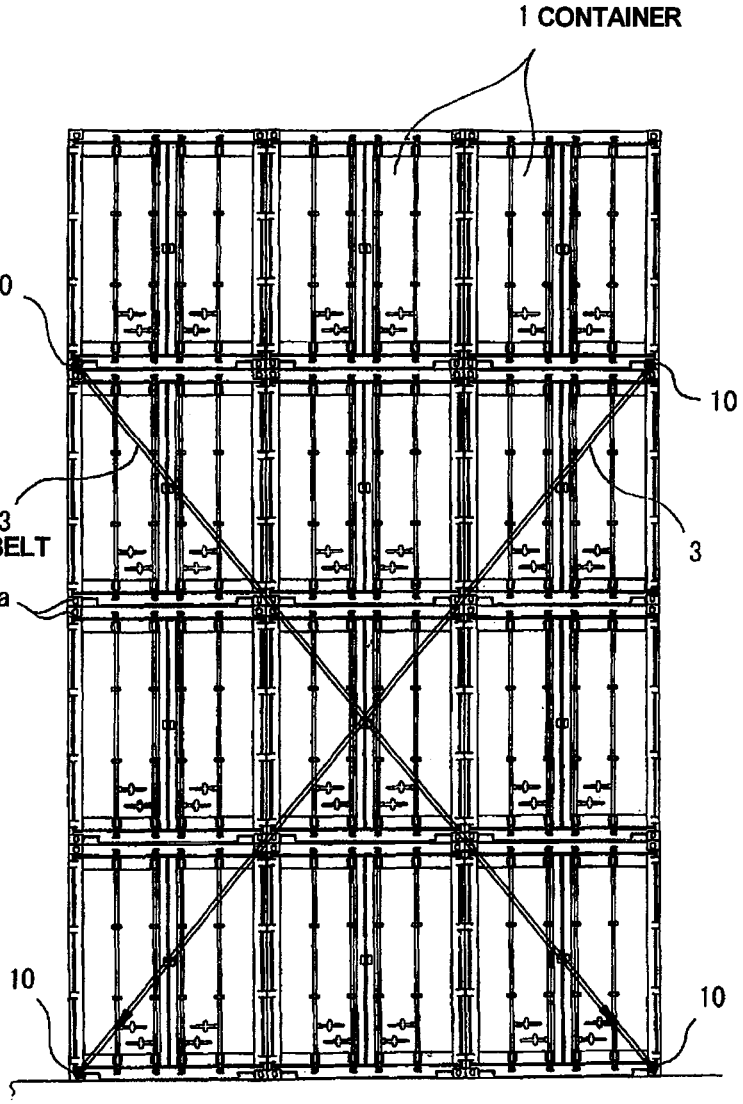

FIGS. 1(*a*) and 1(*b*) illustrate a state where three containers 1 have been lined up horizontally, a total of four stages have been stacked vertically, and a belt 3 and a connecting fitting 10 have been used to connect the same. At one end part of the container 1 as shown in FIG. 1, the uppermost and rightmost container 1 and the lowermost and leftmost container 1 are connected together with the belt 3 and the like as shown in FIG. 1(*a*), and the uppermost and leftmost container 1 and the lowermost and rightmost container 1 are connected with another belt 3 or the like applied in a direction crossing the former belt 3. The containers 1 are similarly connected with the crossing belts 3 also at the other end part which is omitted to be illustrated on the left side of FIG. 1(*b*). Connecting containers 1 in this manner stabilizes the stacked containers 1 to prevent the containers 1 from being collapsed by a strong wind or the like.

A corner fitting 1*a*, also called a casting, is provided to the eight corner parts of each of the containers 1. The connection between the containers 1 is carried out by mounting the connecting fitting 10 on the corner fittings 1*a*. In other words, the connecting fitting 10 is mounted on the corner fitting 1*a* at the lower part of the containers 1 and the belt 3 is connected between the connecting fittings 10, whereupon tension is applied to achieve the connection as shown in FIG. 1.

Figure 2B:
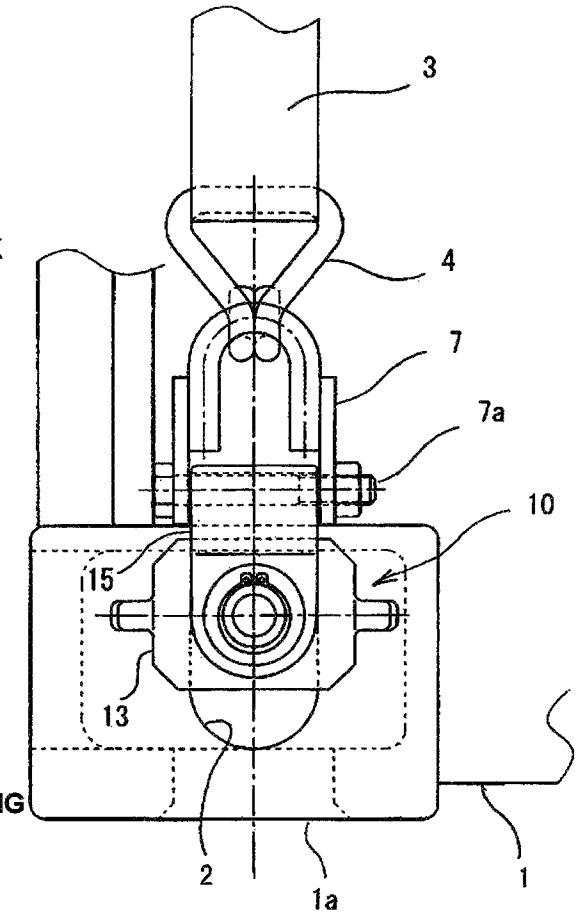
FIG. 2 A drawing for illustrating a state where the connecting fitting 10 is mounted on the container 1, where FIG. 2(*a*) is a detailed view of section II in FIG. 1(*b*) and FIG. 2(*b*) is a front view thereof (a state where the belt 3 is hung vertically).
Figure 2A:
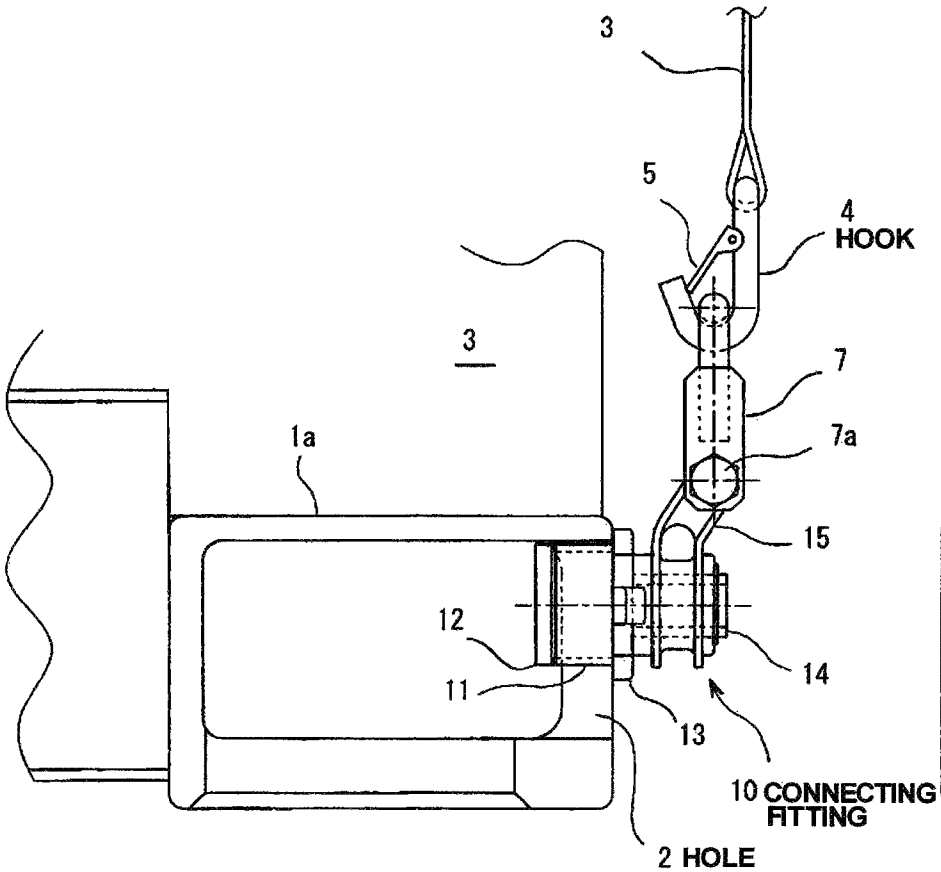
Figure 3A:
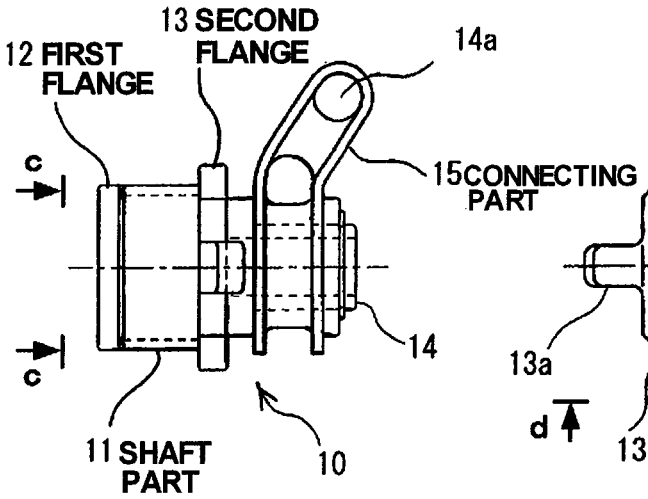
FIG. 3 A drawing for illustrating the connecting fitting 10, where FIG. 3(*a*) is a side view, FIG. 3(*b*) is a front view, FIG. 3(*c*) is a view on arrow c-c in FIG. 3(*a*), and FIG. 3(*d*) is a view on arrow d-d in FIG. 3(*b*).
Figure 3B:
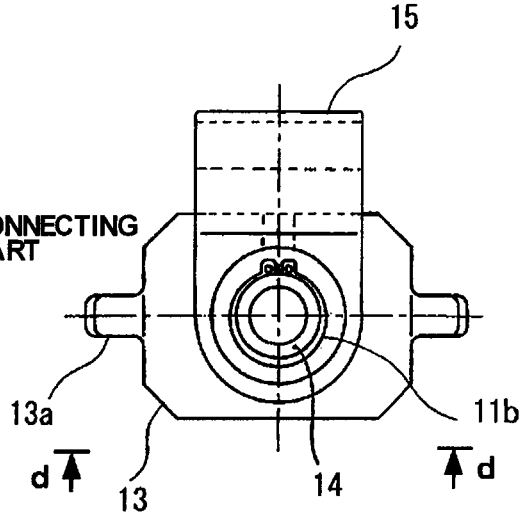
Figure 3C:
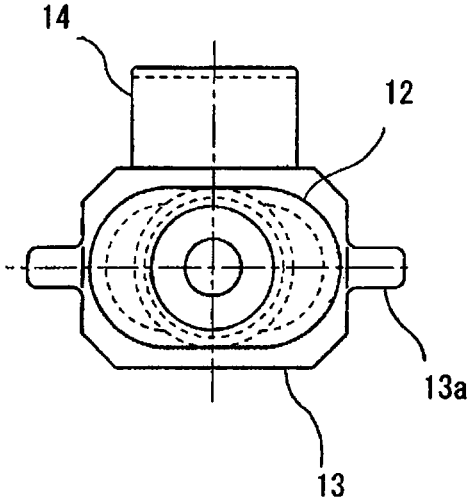
Figure 3D:
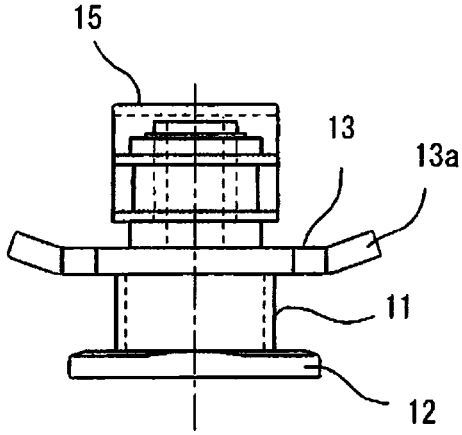

The state where the connecting fitting 10 is mounted on each of the corner fittings 1*a* of the containers 1 is as per the illustration in FIGS. 2(*a*) and 2(*b*). The corner fitting 1*a* has a vertically long oval hole 2, as per the illustration, at a front-part plate, and also has a wide space therebehind. The first flange 12 and the shaft part 11, which is a part of the connecting fitting 10, are inserted into the hole 2 to be prevented from falling out. The belt 3 provided with the hook 4 is connected via a connection-assist fitting 7 to the cable connecting part 15 of the connecting fitting 10 mounted in this manner.

The connecting fitting 10 is made of cast steel, and has a structure as shown in FIGS. 3(*a*) to 3(*d*). Namely, i) In addition to having a cylindrical shaft part 11 that has a cross-section with a perfect circular outer shape and is sized to be insertable into the hole 2 of the corner fitting 2, the connecting fitting 10 has two flanges 12 and 13 placed apart in the length direction. The shaft part 11 and the flanges 12 and 13 are formed integrally by casting.

ii) The first flange 12 is provided on a base end side of the shaft part 11 (the left side in FIG. 3(*a*)), and the outer shape thereof is an oval that is similar to but slightly smaller than the hole 2. This first flange 12 can be passed through the oval hole 2 and inserted into or pulled from the corner fitting 1*a* only when rotated together with the shaft part 11 about the center line thereof to reach positioning at a specific angle, i.e., a position where the long axis of the oval is oriented in the up-down direction.

iii) The second flange 13 is formed on the shaft part 11, spaced from the first flange 12 at an interval slightly greater than the thickness of the front-part plate of the corner fitting 1*a*. The second flange 13 has a sufficiently larger outer shape than the hole 2 of the corner fitting 1*a*, and is sized to be unable to pass through the hole 2. For this reason, the connecting fitting 10 is such that only the first flange 12 and the shaft part 11 can be inserted into the hole 2 of the corner fitting 1*a* when the first flange 12 and the second flange 13 are rotated appropriately together with the shaft part 11 about the center line to appropriately set the angular position of the first flange 12. When the shaft part 11 and the like are rotated by about 90° after insertion and the long axis of the first flange 12 is turned horizontal, the connecting fitting 10 can be mounted on the corner fitting 1*a* as shown in FIG. 2, and the first flange 12 hangs on the plate and does not fall out of the hole 2.

iv) A thin shaft part 14 having the same center line as the shaft part 11 extends from the second flange 13 toward the top end side (the right side in FIG. 3(*a*)), and the cable connecting part 15 is mounted on the outside thereof so as to be able to rotate about the center line without limitation to the angle. The connecting part 15 has a portion that is inclined oriented to be increasingly apart from the second flange 13 as going outward from the center line of the shaft parts 11 and 14, and has a connection hole 15*a* at the tip of the inclined portion. Passing a bolt-nut 7*a* through the connection hole 15*a* as shown in FIG. 2 makes it possible to mount the connection-assist fitting 7. The connection-assist fitting 7 has a U-shaped member on which the hook 4 of the belt 3 (see FIG. 4) can be easily hung.

v) The position of the center of gravity of the connecting fitting 10 is closer to the top end side (closer to the side to which the connecting part 15 is provided; the right side in FIG. 3(*a*)) than the second flange 13, both in a state where the connection-assist fitting 7 is mounted and in a state where the connection-assist fitting is not mounted. For this reason, when the shaft part 11 and the first flange 12 are inserted into the hole 2 of the container 1, a state of uneven contact occurs, where there is a locally large contact surface pressure to the corner fitting 1*a*, as a result, it is difficult for the connecting fitting 10 to rotate even before the belt 3 is connected. When it is difficult for the connecting fitting 10 to rotate, the first flange 12 can be prevented from unintentionally falling out of the hole 2. Additionally the first flange 12 with the long axis being horizontal is brought into contact with a (either upper or lower) horizontal wall surface inside of the corner fitting 1*a* as shown in FIG. 2; this also produce an effect that it is difficult for the connecting fitting 10 to rotate and it is difficult for the first flange 12 to fall out.

vi) As shown in FIGS. 3(*b*) and 3(*d*), the projecting part 13*a* projecting to be orientated outward from the center line of the shaft parts 11 and 14 and oriented to the direction apart from the first flange 12 is formed at two points on the outer edge of the second flange 13. Placing a finger on the projecting part 13*a* allows an operator to easily rotate the connecting fitting 10.

Figure 4A:
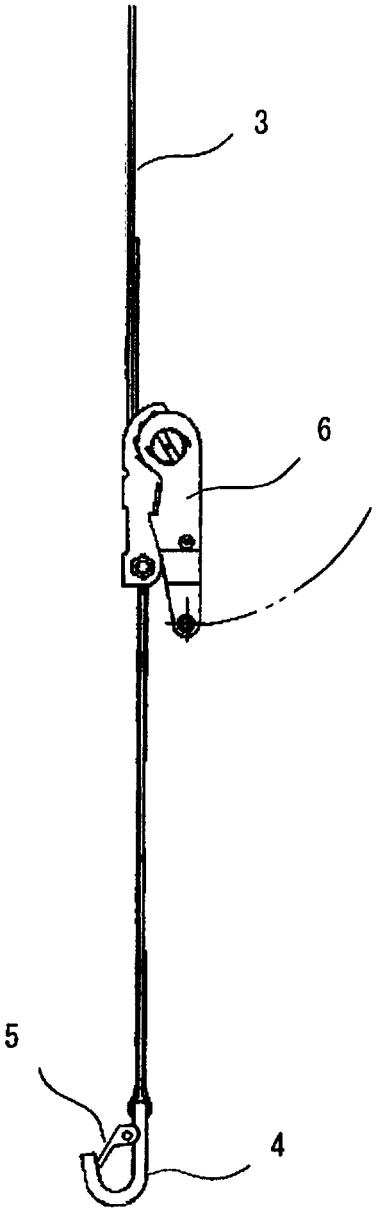
FIG. 4 A drawing for illustrating the connecting belt 3, where FIG. 4(*a*) is a detailed view of section IV in FIG. 1(*b*) and FIG. 4(*b*) is a front view thereof (a state where the belt 3 is hung vertically).
Figure 4B:
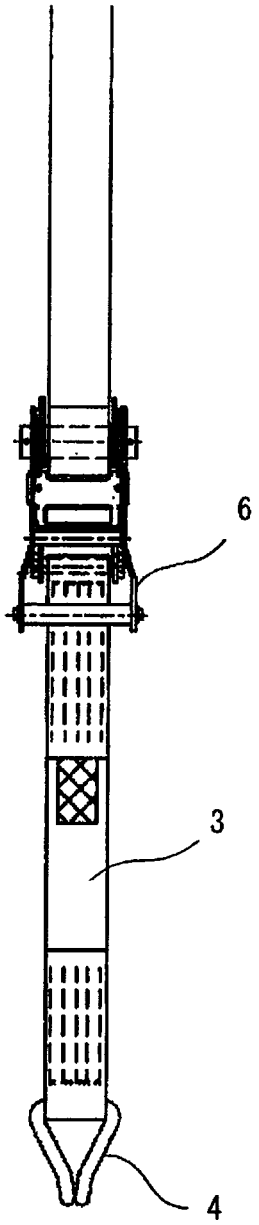

Both the connecting fitting 10 mentioned above and the belt (lashing belt) 3 illustrated in FIG. 4 are used to make a connection for stabilizing the containers 1. The belt 3 is provided with the hook 4 at both end parts of a belt body made of nylon or a similar synthetic fiber; and a ratchet handle 6, for facilitating length adjustments, connected to an intermediate portion (a portion about 1.5 m high from the lower end part during use). The spring-type latching apparatus 5 is provided to the hooks 4 at both end parts (or at least to the hook 4 hung on the fitting 10 of the upper container 1).

The containers 1 are connected using the foregoing connecting fitting 10 and belt 3 as shown in FIG. 1, according to the following procedure, for example.

1) The containers 1 are stacked in order from the lower stage while being lined up with narrowing an interval therebetween; before the uppermost container 1 is stacked, the connecting fitting 10 is mounted on the uppermost container 1 to be connected. This mounting, as described previously, is performed by inserting the first flange 12 and the shaft part 11 of the connecting fitting 10 into the hole 2 of the corner fitting 1*a* and rotating them by about 90°. At each of the containers 1, the connecting fitting 10 is mounted on both the side in FIG. 1(*a*) and the side opposite thereto (not shown).

2) As shown in FIG. 2, the belt 3 is connected via the connection-assist fitting 7 to the connecting part 15 of each of the mounted connecting fittings 10. For this connection, the hook 4 is hung on the U-shaped portion of the connection-assist fitting 7 with the latching apparatus 5 being in action.

3) Each of the containers 1 to be placed at the uppermost stage is stacked thereon sequentially with a crane or the like. The container 1 to which the belt 3 is set is stacked with the belt 3 still suspended.

4) The connecting fitting 10 is mounted on the corner fitting 1*a* of those, of the lowermost containers 1, which are to be connected. This mounting is also performed by inserting the first flange 12 and the shaft part 11 of the connecting fitting 10 into the hole 2 of the corner fitting 1*a* and rotating them by about 90°. The connection-assist fitting 7 is also mounted on the connecting part 15 of the connecting fitting 10.

5) The hook 4 at the lower end part of the belt 3 suspended from the uppermost container 1 is connected to the connecting fitting 10 (connection-assist fitting 7) on the lowermost container 1.

6) The ratchet handle 6 is operated to adjust the length of the belt 3, generating a suitable tension in each of the belts 3.

When the length adjustment for all of the belts 3 is completed, the containers 1 are connected as shown in FIG. 1, so that they are in a stable state against even a strong wind or the like. As per 1) to 3) mentioned above, when the belts 3 are connected in advance to the containers 1 to be placed at the uppermost stage, there is no need for the operator to climb to a high position after stacking.

In a case when the connection between the containers 1 is to be loosed, the ratchet handle 6 is operated to loosen the belts 3, whereupon the inverse operation of the foregoing description is performed in order, for example, going from 6) to 1) above; the belts 3 have been loosened, then the belts 3 and the connecting fittings 10 are removed from the containers 1. In so doing, each of the containers 1 can also be lowered without the need to climb to a high position.

The foregoing description introduced an example where the connecting fitting 10 is used in order to connect the containers 1 to each other, but it will be readily understood that it would also be possible to use the connecting fitting 10 (and belt 3) in a state where the container 1 is anchored to any fixing means on the ground or on a ship.

INDUSTRIAL APPLICABILITY

The container-connecting fitting according to the present invention can be advantageously employed in industries where containers are transported, stored, or the like.

REFERENCE SIGNS LIST

1 Container
2 (Non-circular) hole
3 Belt
4 Hook
5 Latching apparatus
10 connecting fitting
11 Shaft part
12 First flange
13 Second flange
15 Cable connecting part

The invention claimed is:

1. A container-connecting fitting, which is, at a part thereof, fitted into a non-circular hole in a container and is connected to a cable, in order to anchor the container with the cable, wherein the container-connecting fitting has a shaft part to be inserted into the hole, the shaft part comprising opposing first and second sides, with a center line extending therebetween, the first side of the shaft part being provided with a first flange which can pass through the hole only when positioned at a specific angle about the shaft part, and the second side of the shaft part being provided with a second flange that is too large to pass through the hole, and a cable connecting part is mounted on the shaft part opposite the first flange, the second flange being interposed therebetween, wherein the cable connecting part extends radially outward from the center line to an end portion configured to connect to the cable, and wherein the cable connecting part is able to rotate relative to the first flange, without limitation to the angle, about the center line of the shaft part.

2. The container-connecting fitting according to claim 1, wherein in a state where the cable is not connected, the center of gravity of the entire container-connecting fitting is on the side opposite the side where the first flange is present, with the second flange interposed therebetween.

3. The container-connecting fitting according to claim 1, wherein a projecting part projecting in a direction oriented outward from the center line of the shaft part or in a direction oriented opposite the side where the first flange is present is formed on the second flange.

4. The container-connecting fitting according to claim 1, wherein the cable connecting part has an inclined portion oriented to be increasingly apart from the second flange as going outward from the center line of the shaft part, and has a connection hole at the tip of the inclined portion.

5. The container-connecting fitting according to claim 1, wherein the cable comprises a belt having a hook at an end part thereof, the belt including a latching apparatus and a ratchet handle.

6. A container-connecting fitting, which is, at a part thereof, fitted into a non-circular hole in a container and is connected to a cable, in order to anchor the container with the cable, wherein the container-connecting fitting has a shaft part to be inserted into the hole, the shaft part comprising opposing first and second sides, with a center line extending therebetween, the first side of the shaft part being provided with a first flange which can pass through the hole only when positioned at a specific angle about the shaft part, and the second side of the shaft part being provided with a second flange that is too large to pass through the hole, the first flange and the second flange being integral or rigid with the shaft part, and a cable connecting part is mounted to an extension of said shaft part adjacent the second flange and opposite the first flange, wherein the cable connecting part extends radially outward from the center line to an end portion configured to connect to the cable, and wherein the cable connecting part is able to rotate relative to the first flange, without limitation to the angle, about the center line.

7. The container-connecting fitting according to claim 6, wherein in a state where the cable is not connected, the center of gravity of the entire container-connecting fitting is on the extension of the shaft part.

8. The container-connecting fitting according to claim 6, wherein a projecting part projecting in a direction oriented outward from the center line of the shaft part or in a direction oriented opposite the side where the first flange is present is formed on the second flange.

9. The container-connecting fitting according to claim 6, wherein the cable connecting part has an inclined portion oriented to be increasingly apart from the second flange as going outward from the center line of the shaft part, and has a connection hole at the tip of the inclined portion.

10. The container-connecting fitting according to claim 6, wherein the cable comprises a belt having a hook at an end part thereof, the belt including a latching apparatus and a ratchet handle.

* * * * *